US008490704B2

(12) United States Patent
Caro et al.

(10) Patent No.: US 8,490,704 B2
(45) Date of Patent: Jul. 23, 2013

(54) TECHNIQUE OF FRACTURING WITH SELECTIVE STREAM INJECTION

(75) Inventors: Diana Paola Olarte Caro, Veracruz (MX); Renny Yeguez, Bogota (CO)

(73) Assignee: Schlumberger Technology, Sugar Land, TX (US)

( * ) Notice: Subject to any disclaimer, the term of this patent is extended or adjusted under 35 U.S.C. 154(b) by 356 days.

(21) Appl. No.: 12/848,690

(22) Filed: Aug. 2, 2010

(65) Prior Publication Data

US 2011/0198088 A1 Aug. 18, 2011

Related U.S. Application Data

(60) Provisional application No. 61/266,659, filed on Dec. 4, 2009.

(51) Int. Cl.

| | |
|---|---|
| ***E21B 43/14*** | (2006.01) |
| ***E21B 33/124*** | (2006.01) |
| ***E21B 34/14*** | (2006.01) |
| ***E21B 49/00*** | (2006.01) |

(52) U.S. Cl.
USPC ..... 166/308.1; 166/250.1; 166/250.17; 166/177.5

(58) Field of Classification Search
USPC ..... 166/191, 263, 305.1, 306, 308.1, 166/308.3, 177.5, 250.1, 250.02, 250.17
See application file for complete search history.

(56) References Cited

U.S. PATENT DOCUMENTS

| | | | | |
|---|---|---|---|---|
| 3,051,243 | A * | 8/1962 | Grimmer et al. | 166/332.7 |
| 3,245,470 | A * | 4/1966 | Henry | 166/280.1 |
| 3,381,749 | A * | 5/1968 | Chenoweth | 166/55 |
| 3,454,085 | A * | 7/1969 | Bostock | 166/66 |
| 7,066,265 | B2 * | 6/2006 | Surjaatmadja | 166/308.1 |
| 7,096,954 | B2 * | 8/2006 | Weng et al. | 166/308.1 |
| 7,134,505 | B2 * | 11/2006 | Fehr et al. | 166/387 |
| 8,360,145 | B2 * | 1/2013 | Kalman et al. | 166/250.01 |
| 2001/0050170 | A1 * | 12/2001 | Woie et al. | 166/252.1 |
| 2003/0079875 | A1 * | 5/2003 | Weng | 166/250.07 |
| 2003/0173086 | A1 * | 9/2003 | Howard et al. | 166/305.1 |
| 2005/0022988 | A1 | 2/2005 | Bassin et al. | |
| 2006/0054316 | A1 | 3/2006 | Heaney et al. | |
| 2008/0179060 | A1 * | 7/2008 | Surjaatmadja et al. | 166/298 |
| 2009/0078427 | A1 | 3/2009 | Patel | |
| 2009/0294123 | A1 * | 12/2009 | Mescall et al. | 166/250.01 |
| 2011/0209868 | A1 * | 9/2011 | Dusterhoft et al. | 166/250.1 |

OTHER PUBLICATIONS

Palisch, T.T., "Proppantless Fracture Stimulations in Injection Wells—A Case History", Society of Petroleum Engineers 35697, 1996, pp. 471-481.

* cited by examiner

*Primary Examiner* — Kenneth L Thompson
(74) *Attorney, Agent, or Firm* — Colin Wier; Rodney Warfford

(57) ABSTRACT

A technique facilitates enhanced hydrocarbon recovery through selective stream injection. The technique employs a system and methodology for combining a fracturing technique and application of selective injection streams. The selective injection streams are delivered to select, individual subterranean layers until a plurality of unique subterranean layers are fractured to enhance hydrocarbon recovery.

21 Claims, 7 Drawing Sheets

TECHNIQUE OF FRACTURING WITH SELECTIVE STREAM INJECTION

CROSS-REFERENCE TO RELATED APPLICATION

The present document is based on and claims priority to U.S. Provisional Application Ser. No. 61/266,659, filed Dec. 4, 2009.

BACKGROUND

In certain well applications, recovery of hydrocarbon based fluids can decline over time to uneconomical levels. Sometimes, the recovery of hydrocarbons may be enhanced through the injection of fluids, and such techniques are referred to as secondary recovery or enhanced recovery methods. In one technique known as waterflooding, water is injected to displace oil toward a producer well. However, hydrocarbon gases, CO2, air, steam, and other fluids may be injected to enhance recovery of the desired hydrocarbons. Various fracturing techniques, including proppantless fracturing techniques, also have been employed to facilitate recovery of hydrocarbons from certain subterranean formations. Because the composition of subterranean formations often is layered, adequate control over fracturing and/or injection of the fluids is difficult due to the many unique layers holding the hydrocarbon based fluids.

SUMMARY

In general, the present invention comprises a system and methodology which combines a well stimulation technique, e.g. a proppantless fracturing technique, and application of selective injection streams at multiple unique subterranean layers to enhance hydrocarbon recovery.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
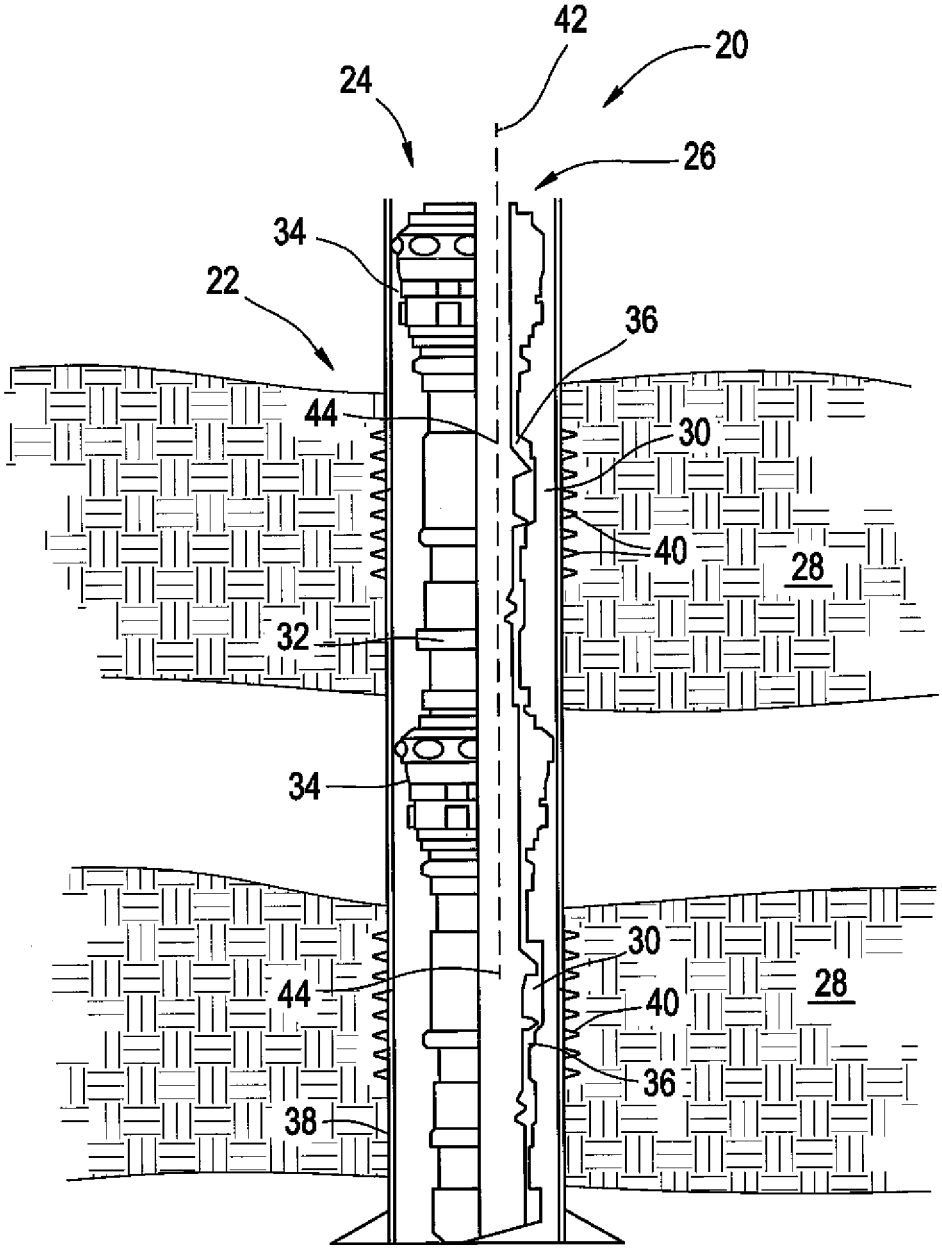
FIG. 1 is an illustration of a system for enhancing a fluid injection profile to multiple levels along a wellbore, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology for improving a fluid injection profile in fluid injector wells to thereby induce enhanced recovery of hydrocarbons, e.g. oil, from subterranean regions. The technique is useful in increasing the percentage of hydrocarbon based fluids recovered from a plurality of formation layers formed through a given subterranean region. According to one embodiment, selective injection streams (SIS) are used to regulate the injection of fluids, e.g. liquids, gases, steam, into formation layers through flow regulators positioned between isolating devices. Use of the selective injection streams also distributes the injected fluids more efficiently through the formation layers which increases the vertical efficiency and increases the recovery of hydrocarbons.

As described in greater detail below, the technique improves injection of fluids and enhances hydrocarbon recovery which, as a consequence, increases hydrocarbon production. Various aspects of the present technique comprise the injection of fluids into specific, selected subterranean layers to create individual fractures in those layers. The selective injection stream technique is employed to increase the number of unique formation layers which are fractured. In some applications, complementary chemicals, e.g. acids or solvents, are delivered to each formation layer to improve the fracturing process and/or the duration of the created fractures. Additionally, various analyses may be performed prior to, during, and/or after the fracturing operation. The selective stream injection also increases the number of formation/reservoir layers which may be fractured in a single downhole operation.

According to one embodiment, the technique may be used to improve the effectiveness of fluid injected, e.g. waterflooding methods, to enhance hydrocarbon recovery. In this embodiment, fluid, e.g. water or another suitable fluid, is introduced into a subterranean region to create different, individual fractures using a selective fluid injection stream. The selective fluid injection stream is sequentially directed into each isolated layer or at least into some of the isolated layers of a plurality of formation layers to cause enhanced fracturing along the entire subterranean region. The fracturing is accomplished through one or more downhole flow control devices, e.g. regulator valves, associated with each individual layer or each specific group of selected layers.

In many applications, the deepest layer is initially fractured using the deepest associated mandrel (with or without a flow control device, e.g. flow regulator valves, installed therein), while blocking the upper regulator valves with "dummy" or "blind" valves (or other no-flow valves) to guarantee injection of fluid through the selected mandrel and into the selected formation layer. For example, the technique can be applied with free mandrels (if high wellhead pressure limitations are presented) or with flow regulator valves or other suitable flow devices disposed in the mandrel. The operation can be repeated through other mandrels to selectively and sequentially fracture each of the subsequent formation layers while the other layers are isolated. In some cases, a device may be installed into the mandrel for the purpose of protecting the mandrel integrity from the effects of pressure and/or corrosion during the fracturing process.

In some applications, complementary chemicals are injected or otherwise delivered into the individual layers prior to or after fracturing pumping. For example, acids, e.g. hydrochloric acid (HCl), mutual solvents, diesel, paraffin or asphalten solvents may be delivered to the desired formation layer followed by or preceded by the fracturing pumping. The complementary chemicals improve the fracturing process and/or the duration of the fracture. However, use of complementary chemicals may not be required in all applications.

The technique also may comprise employing an analysis process to evaluate and monitor aspects of the hydrocarbon production enhancement. The analysis may be performed prior to, during, and/or after the operation, and various monitoring techniques may be continued following the operation. For example, the analysis may be performed prior to the fracturing operation by screening criteria to facilitate selection of well candidates for which the present technique is suitable. The pre-operation analysis may comprise evaluating well parameters, including mechanical integrity, injection and fracture pressure, geological correlations, petrophysics, reserves calculations, production profiles, operational aspects, risk evaluation, planning of the operation, and economics of the operation.

The analysis also may comprise operational aspects, including definition of the fracture pressure which may be obtained through, for example, "step rate tests" as described below. Other operational aspects may include defining the pressure increment employed during the fracture operation, and implementing the operation (or contingency plan if necessary). The analysis also may comprise ongoing monitoring techniques which include monitoring of well parameters, e.g. flow rates, pressures, and water/fluid quality. Monitoring may be achieved with a variety of technologies, including tracers, spinners, distributed temperature sensing fiber optic systems, and/or other technologies designed to measure injection rates at each formation layer, e.g. injection rates through specific regulator valves at each formation layer. The monitoring techniques also may comprise the use of mathematical models to reproduce dynamic aspects of the reservoirs, formation layers, and overall well performance. The injection rates for a given layer or layers may be modified according to the results of the modeling.

Referring generally to FIG. 1, a well system 20 is illustrated as deployed in a well 22, having at least one wellbore 24, to facilitate individual fracturing of a plurality of formation layers by improving the fluid injection profile and therefore enhancing hydrocarbon recovery. The well system 20 comprises a selective injection completion 26 designed to improve the vertical sweeping by enabling the controlled injection of fluid into individual, selected formation layers 28 of a plurality of formation layers 28. The completion 26 provides control over the injection flow, e.g. water injection flow, to individual formation layers 28 via corresponding mandrels/flow control devices 30. By way of example, the mandrels/flow control devices 30 may comprise flow regulators, e.g. water flow regulators (WFR), such as flow regulator valves. The mandrels/flow regulators 30 provide better control over the injection profile throughout the reservoir and the individual formation layers 28 of that reservoir.

In the specific example illustrated in FIG. 1, the selective injection completion 26 comprises a tubing string 32 having isolation devices 34, e.g. packers. In the specific embodiment illustrated, the mandrels/flow control devices 30 may comprise flow regulator valves disposed in side pocket mandrels 36. In some applications, the flow regulators 30 comprise dummy valves. Additionally, the side pocket mandrels 36 are independently isolated between packers 34, thus allowing separate injection, e.g. water injection, into specific, selected formation layers 28 according to a specific pattern profile design. This ability substantially enhances the fracturing operation via the selective injection while isolating the other well zones/formation layers from the fracturing pressure. It also should be noted that in the embodiment illustrated, tubing string 32 is deployed within a surrounding casing 38 having perforations 40 associated with each formation layer 28 to enable flow of injection fluid from the tubing string 32, through the appropriate flow control device 30, through the corresponding perforations 40, and into the selected, surrounding formation layer 28.

Depending on the injection/fracturing application and on the surrounding environment, well system 20 may comprise a variety of other components to facilitate injection and/or monitoring of the procedure. For example, a sensor system 42 may be deployed downhole with tubing string 32 to monitor the fracturing of each formation layer 28. The sensor system 42 may be deployed within tubing string 32, along the exterior of tubing string 32, or at a location separated from tubing string, such as along casing 38. Additionally, the sensor system 42 may comprise a variety of sensors 44, e.g. distributed sensors or discrete sensors, designed to measure desired parameters, such as pressure, temperature, flow rate, porosity, or other parameters related to the stimulation procedure and/or surrounding reservoir. The sensor system 42 is useful for collecting data to enable various analyses prior to, during, and/or after fracturing of individual layers 28.

To better recognize candidate wells (e.g. a well screening process) and/or to better respond to low injection rates detected in some formation layers, a detailed review of possible problems affecting injection water restriction may be performed. A screening process of problems and their possible associated solutions may be conducted to determine the more appropriate stimulation system to be employed with the present technique. In some applications, the screening process may be based on the principle of formation/perforations breakdown and the creation of conductor channels within the formation by proppantless fluid, such as water.

Figure 2:
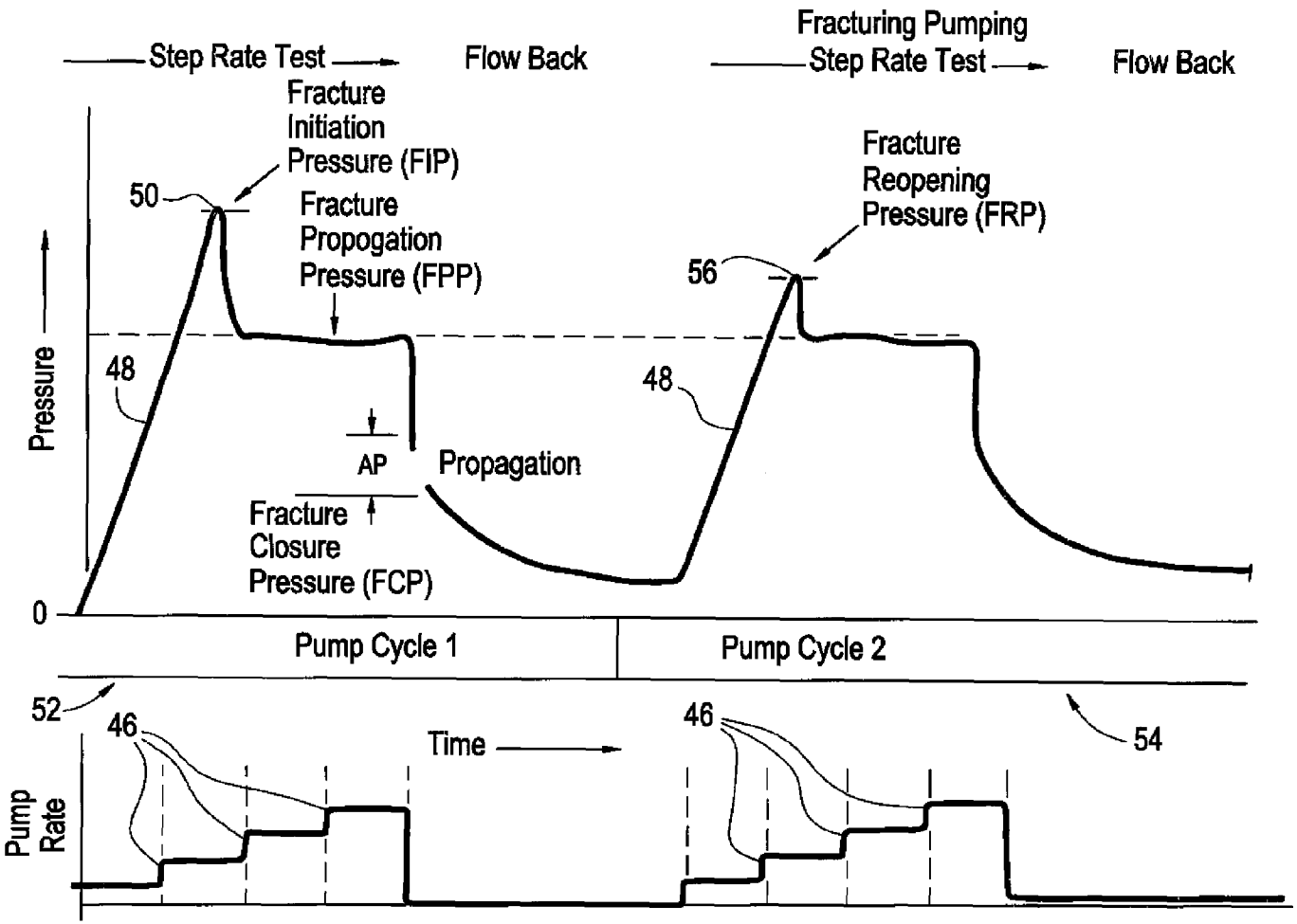
FIG. 2 is a graph illustrating one technique for screening/fracturing a formation layer to improve fluid injection rate which enhances hydrocarbon production, according to an embodiment of the present invention.

Referring generally to FIG. 2, the fracturing process may involve pumping the injection fluid, e.g. water or another suitable fluid, in a "step rate test" procedure followed by the flow back. It should be noted a pump cycle comprises both of the previously mentioned stages (pumping the injection fluid and flow back). The step rate test procedure comprises a series of successively higher injection rates for which pressure values are read and recorded at each rate and time step 46, as illustrated in FIG. 2. In FIG. 2, a plot of injection rates and the corresponding stabilized pressure values are graphically represented as a constant slope straight line 48 to a point 50 at which the formation fracture, or "breakdown", pressure is exceeded (FTP) in a first pump cycle 52. The flow back stage is then performed to allow the transition between pump cycles and to increase the formation perturbations. A second pump cycle 54 is performed and a fracture re-opening pressure (FRP) 56 effectively becomes the parameter for evaluating the effectiveness of the stimulation process and also for ranking the success of the treatment. The success ranking depends on the differential pressure achieved when the fracture re-opening pressure 56 is compared with the injection pressure of fluid from the fluid injection plant, e.g. water injection plant. The re-opening fracture pressure could be affected every time the pumping cycle is done, reducing the effective re-opening pressure. The cycles may be repeated until the reduction in such pressure is considered profitable. Performing several cycles increases formation perturbations which induces fatigue and makes the formation weaker. This is demonstrated by a decrease in the reopening pressure due to reduction in the tensile strength and Young's Modulus of the formation.

Figure 3:
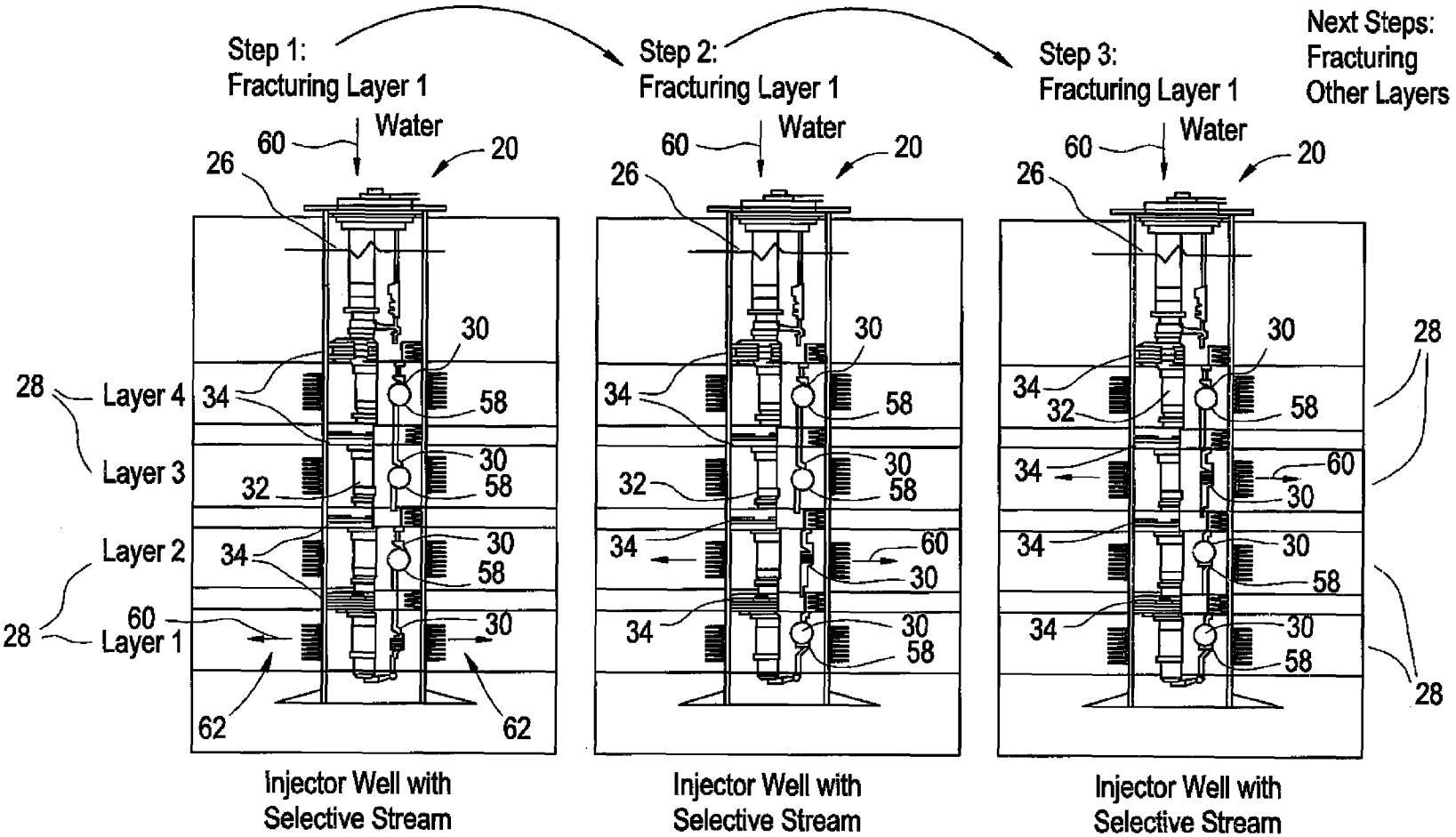
FIG. 3 is a schematic illustration showing the sequential fracturing of multiple formation layers, according to an embodiment of the present invention.

In the present technique for enhancing hydrocarbon recovery, vertical sweeping efficiency is an important factor, and that factor is addressed by the selective stream completion 26 when used for fracture stimulation. Furthermore, the fracture stimulation via selective stream completion 26 provides a technique directly focused on improving vertical efficiency at a low cost and low risk. Another attribute of the technique is maintaining selectivity in the injection because the fractures are selectively performed in accordance with the selective string arrangement. The fracturing technique is designed to avoid communication between formations while substantially enhancing conductivity of flow along a selected or determined formation. In the embodiment of FIG. 3, the sequential stimulation, e.g. fracturing, of individual formation layers 28 is illustrated. In this example, the selective injection completion 26 is used to fracture individual layers 28 or specific groups of layers through the empty mandrel (or using flow control devices) 30 having "dummy" or "blind" valves 58 to block injection of fluid into other layers of the subterranean region. In that way, injection of fluid is concentrated through a selected control device(s) 30 and into the specific layer or group of layers 28 to be fractured.

As illustrated in the embodiment of FIG. 3, the injection sequence is repeated for each layer or group of layers of the subterranean region. Initially, the dummy valves 58 are used to block flow into the upper formation layers 28, while the lowermost formation layer 28 is fractured or otherwise stimulated. In the specific example illustrated, a well stimulation fluid 60, e.g. a water-based fracturing fluid, is first delivered down through tubing string 32. In this example, the fracturing fluid is flowed outwardly through the lowermost mandrel 30 and into the lowermost formation zone 28 to create the desired fractures 62, as illustrated in the left portion of FIG. 3.

After fracturing the lowermost formation layer 28, it is blocked by dummy valve 58, as illustrated in the middle portion of FIG. 3. The flow control device 30 of the next sequential formation layer 28 to be stimulated, e.g. fractured, is then opened to allow the outflow of fluid 60, as illustrated. While a given formation layer 28 is fractured (or otherwise stimulated), the other formation layers 28 are isolated from the pressure of the fracturing fluid via packers 34 and the closed flow control devices 30 in those other well zones. This process of introducing an injection fluid into a selected formation layer 28 while isolating the other formation layers is repeated for each sequential formation layer, as further illustrated in the rightmost portion of FIG. 3. To obtain desired isolation or inclusion, different options may be employed, e.g. selective dummy or blind valve installation and retrieval.

The flow control devices 30 may be actuated between open and closed positions via a variety of actuators depending on the design of the flow control device. With certain flow regulator valves, including dummy valves 58, a shifting tool may be moved downhole to manipulate the appropriate valve. For example, injection into specific layers 28 may be achieved by moving/actuating/retrieving the regulator valves 30/58 via a low-cost slickline operation. As result, it is not necessary to pull out the selective string to make individual fractures, thus avoiding substantial costs associated with the rig rate and required replacement tools.

Figure 4:
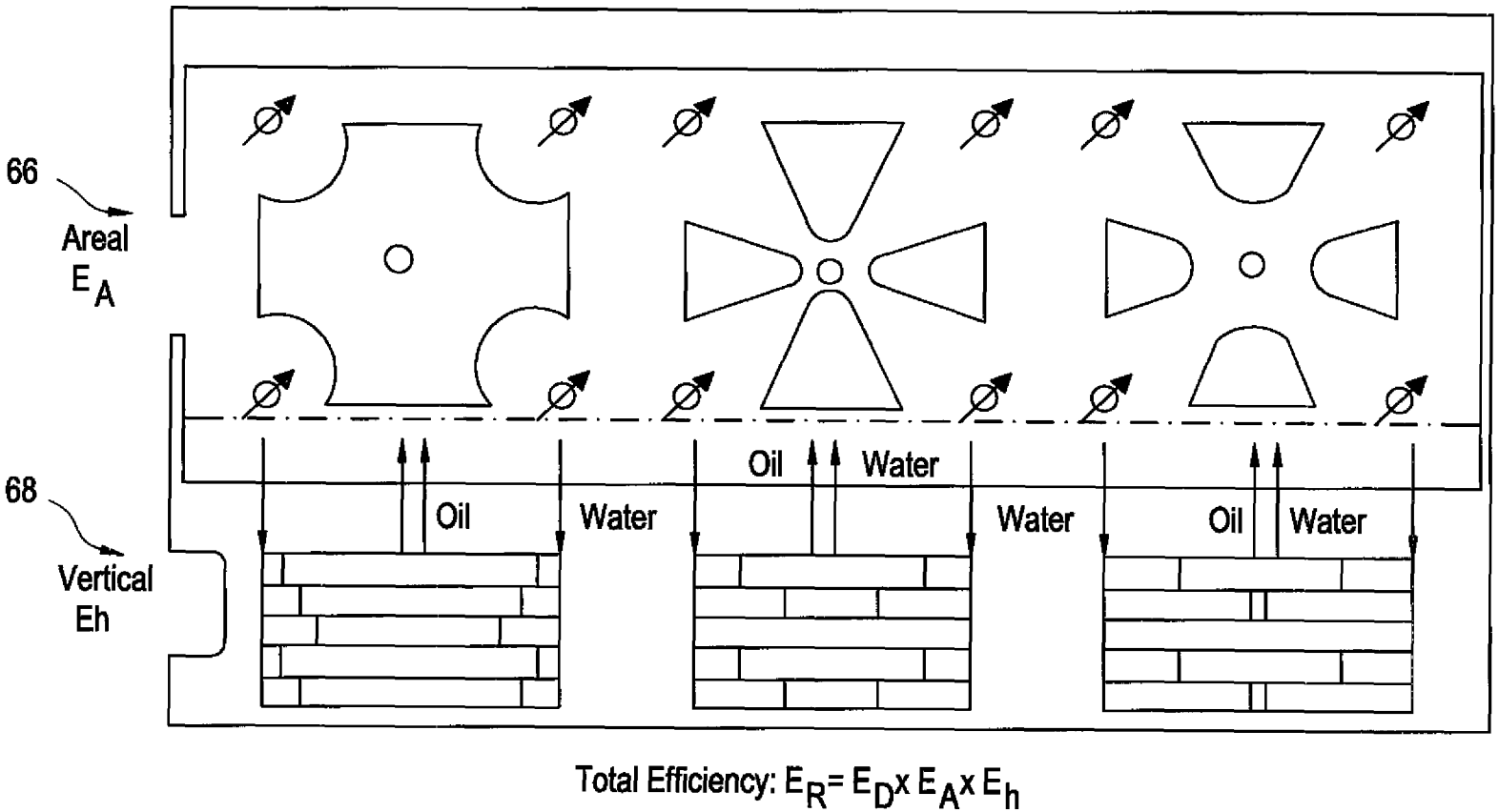
FIG. 4 is a graphical illustration of the efficiency improvements following a multi-level fracturing technique, according to an embodiment of the present invention.

The selective stream injection technique substantially increases the efficiency of hydrocarbon recovery from a variety of wells. Improvements are provided with respect to not only vertical efficiency but also with respect to areal efficiency and total efficiency or recovery factor. Referring generally to FIG. 4, a graphical illustration is provided to illustrate the substantial improvements in various efficiency measurements when the present "fracturing with selective stream injection technique" is employed to recover hydrocarbons from a subterranean region.

As illustrated in the example of FIG. 4, areal efficiency is substantially improved, is illustrated by upper portion 66 of the graphical representation in FIG. 4. In this particular example, the areal efficiency is based on a well configuration in which four injector wells are employed in the corners of a pattern of wells, and a producer well is located in the center of the pattern. Over time, the injected fluid flows into the porous media displacing oil to the producer well. The ratio between the area flooded with water and the area of the pattern (a rectangle in this case) is referred to as areal efficiency. It should be noted that a variety of patterns of the injector wells and producer wells may be employed depending on the characteristics of the application and reservoir environment. As additional formation layers are reached by the injected fluids, the areal efficiency increases in these particular formation layers, thus improving the overall areal efficiency.

Vertical efficiency is illustrated in a lower portion 68 of the graphical representation in FIG. 4 by a schematic cross-sectional view of formation layers 28 at three different times. In this example, five different formation layers 28 are flooded with water 60. The injected water 60 is distributed in the different formation layers according to the petrophysical properties, e.g. permeability and thickness of the layers; formation damage during the well completion; and/or pore pressure. In this example, the vertical efficiency is the ratio between the volume of the layers flooded and the total volume of the layers. The vertical efficiency, in particular, can be substantially improved through the use of the technique described herein which employs fracturing with selective stream injection of individual formation layers 28. However, the total efficiency or recovery factor, ER, also is improved and is the product of three efficiencies, namely displacement efficiency, areal efficiency, and vertical efficiency.

The fracturing with selective injection stream technique may be employed in a variety of environments with many types of wells. However, one embodiment of the methodology for carrying out this technique comprises initially preparing a well for intervention. At this initial stage, each layer 28 to be individually treated is properly prepared to ensure the integrity of the selective injection completion 26 and to verify each formation layer 28 has treatment isolation/independency with respect to the other layers 28. In some applications, an optional "pickling" job is performed at this stage by delivering a complementary chemical into one or more individual formation layers. For example, HCl may be delivered downhole to clean the injection string or tubing 32 by eliminating residual components in the walls of the tubing which could otherwise block the flow control devices/valves 30 or damage the formation layers 28.

Figure 5:
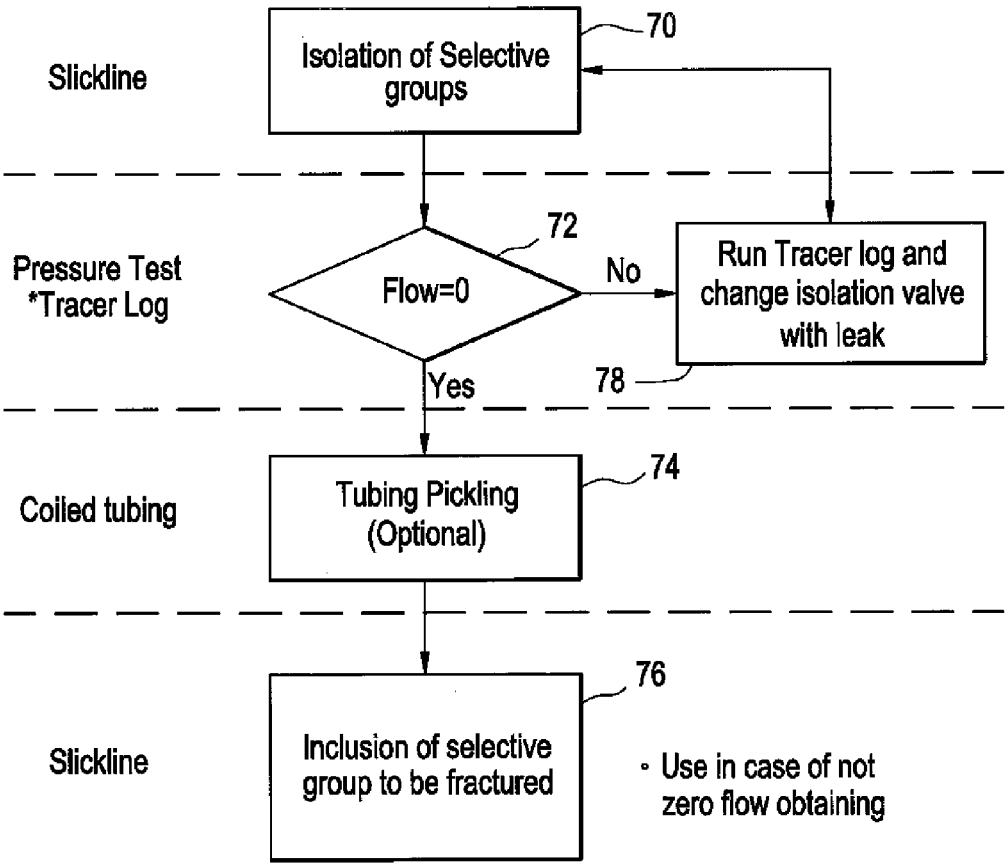
FIG. 5 is a flowchart illustrating an operational procedure related to stimulation pumping which is employed to facilitate sequential fracturing of a plurality of formation levels, according to an embodiment of the present invention.

The initial segments of one embodiment of the procedure are illustrated in the flowchart of FIG. 5. In this specific example, a slickline may be used to isolate formation layers with dummy valves 58, as illustrated by block 70. The system is then flow tested by a pressure test, as represented by decision block 72. If the flow is zero, an optional pickling operation may be performed by directing a complementary chemical, e.g. HCl, downhole, as represented by block 74, prior to inclusion of the selective group to be fractured, as represented by block 76. If, on the other hand, flow is detected as an indication of lack of isolation, a tracer log may be run and the dummy valves 58 may be readjusted and/or the equipment may be re-run downhole, as represented by block 78.

In a subsequent stage of the technique, the injection fluid 60, e.g. water or another suitable fluid, is delivered downhole and introduced into a specific layer or group of layers 28 between packers 34 to create individual fractures 62 in the specific layer(s), as discussed above with reference to FIG. 3. The selective fluid injection stream 60 can be used sequentially on individual, isolated formation layers 28 to increase the number of formation layers 28 that may be independently fractured. Consequently, the selective stream technique enables independent treatments on specific layers and optimizes the effective channeling creation throughout the overall formation. In many applications, brine may be used as a fracture fluid when formation layers are sensitive to untreated water.

Figure 6:
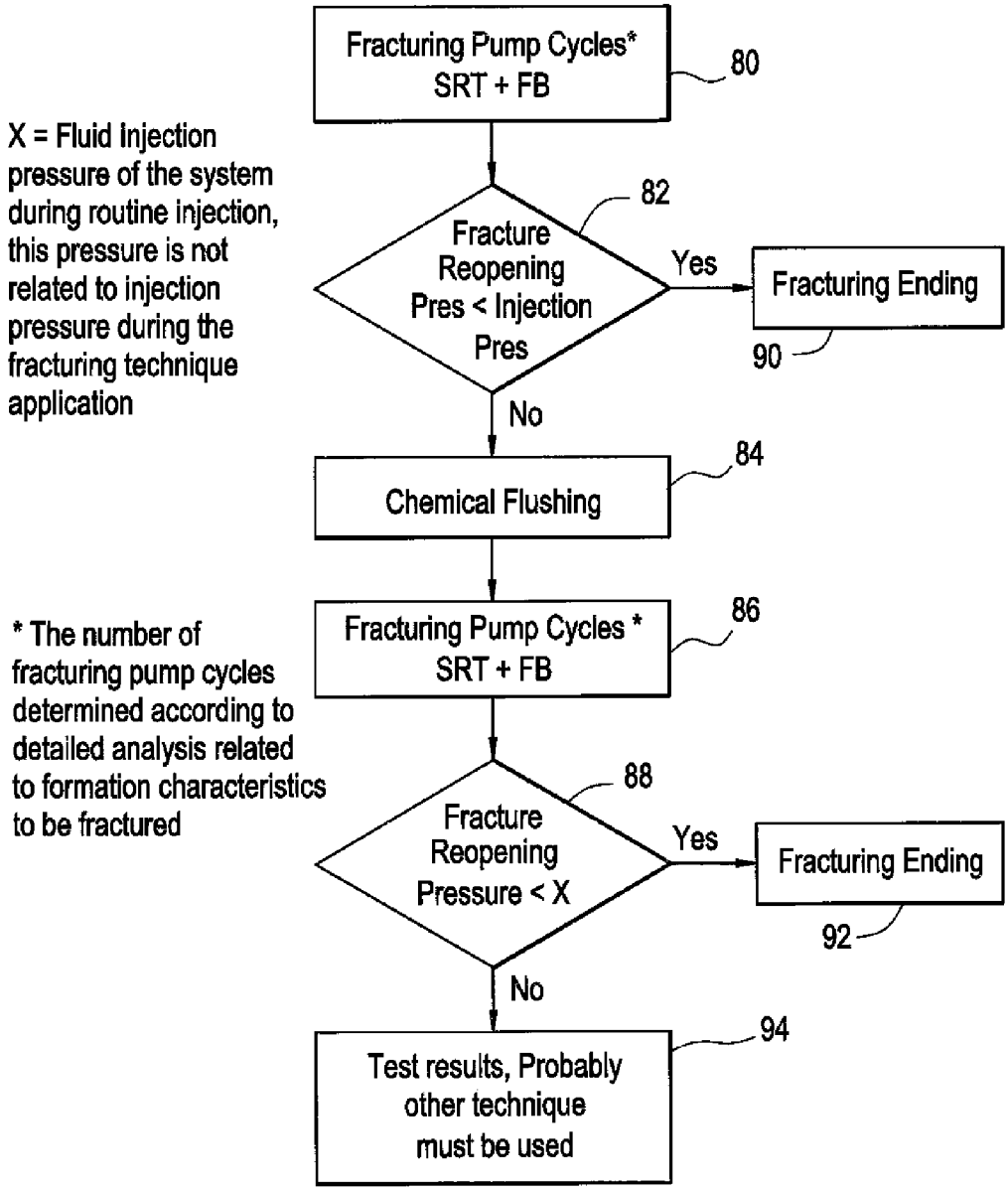
FIG. 6 is a flowchart illustrating a fracturing pumping technique employed to facilitate sequential fracturing of a plurality of formation levels, according to an embodiment of the present invention.

Referring generally to FIG. 6, a flow chart is provided to illustrate one procedure for carrying out the fracturing process discussed above with reference to FIG. 2. Initially, several fracturing pump cycles may be performed, as represented by block 80. The fracturing pump cycles may be performed through two different stages, the first of which is a step rate test or the fluid injection stage when fluid 60 is injected into a desired, selected formation layer to be fractured. The second stage is a flow back stage (not a fluid injection stage) which allows the pump cycles to transition and increase the perturbation effect to the formation. In operational conditions, the fluid injection wells work under a specific injection pressure established by the pumping capacity of the surface facilities of the hydrocarbon field as provided for retaining injection operations. However, this specific injection pressure is not related to any injection pressure obtained during the fracturing process application. This specific injection pressure could be measured for any formation through dynamic pressure profiling when fluid injection is performed in a particular well at normal operating conditions.

Accordingly, the required injection pressure must be available/obtained before performing the fracturing process described herein. The number of fracturing pump cycles may be determined according to, for example, detailed analysis related to formation characteristics and a cost-benefit analysis of the operation. Upon ending the fracturing pumping cycles, the last fracture reopening pressure obtained is compared to the injection pressure previously defined, as represented by decision block 82. If the fracture reopening pressure is above the injection pressure value, then a chemical flushing may be performed, as represented by block 84. Subsequently, several fracturing pumping cycles may again be carried out, as represented by block 86, until the fracture reopening pressure is less than the injection pressure, as represented by decision block 88. If the fracture reopening pressure is less than the injection pressure, the fracturing pumping is stopped and the fracturing is ended, as represented by blocks 90 and 92. If there is difficulty in achieving a fracturing reopening pressure which is less than the injection pressure, additional testing and/or other techniques may be employed, as represented by block 94.

As discussed above, chemicals may be directed downhole with and/or in addition to the injection stream 60 to facilitate or enhance the fracturing process. If, for example, a limitation in injection rate occurs due to near wellbore restrictions, complementary chemicals (e.g. hydrochloric acid (HCl), mutual solvents, diesel, paraffin or asphalten solvents) may be added to improve the fracturing process and the duration of the fracture. In some applications, the complementary chemicals may be added during the step rate test.

Figure 7:
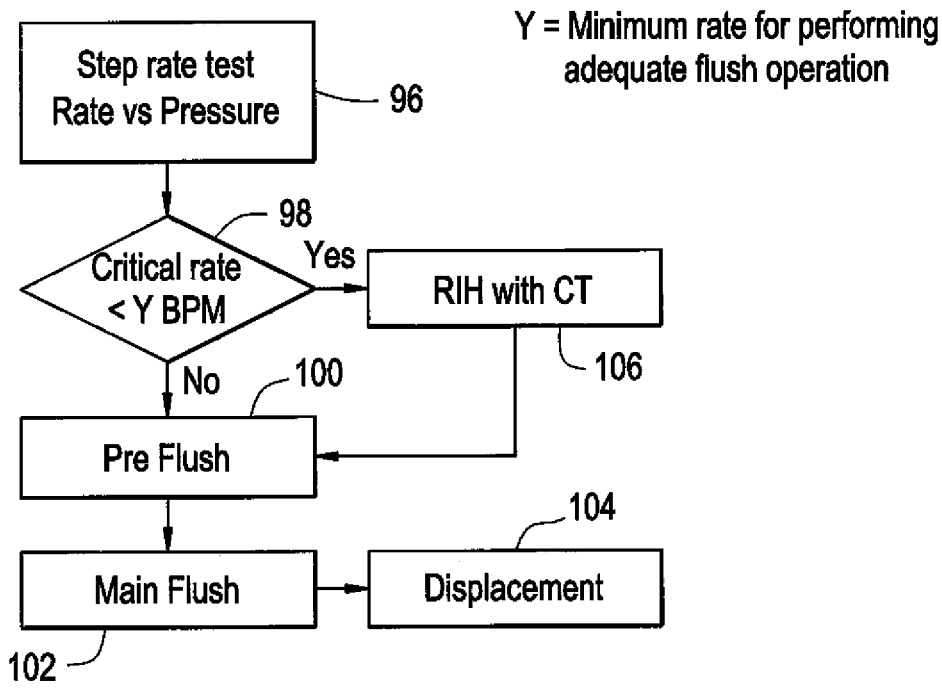
FIG. 7 is a flowchart illustrating fluid flushing with chemicals, e.g. acids or solvents, which may be employed to facilitate sequential fracturing of a plurality of formation levels, according to an embodiment of the present invention.

Referring generally to the flowchart of FIG. 7, one example of the addition of complementary chemicals pumping is illustrated. During an initial step rate test, the injection rate is compared to the injection pressure, as illustrated by block 96. The injection rate is compared to a predetermined value Y, as represented by decision block 98. If the injection rate is above the value Y, then a pre-flush is employed in which a complementary chemical, e.g. HCl, is delivered downhole to the desired well zone/formation layer, as represented by block 100.

Subsequently, a flush procedure is delivered downhole with an additional, or stronger, complementary chemical, as represented by block 102. The flush procedure may be followed with a displacement fluid procedure, as represented by block 104.

Referring again to the decision block 98. If the injection rate is below the value Y, then an appropriate tool on coiled tubing may be run in hole, as represented by block 106. The coiled tubing is used to conduct and supplement the pre-flush procedure, as represented by block 100. Subsequently, the flush and displacement procedures may be conducted, as represented by blocks 102, 104.

The technique of fracturing with selective stream injection may be employed in a variety of wells formed in many types of subterranean regions. The number of formation layers independently treated in fluid injector wells to improve hydrocarbon recovery in producers, as well as the number and type of packers, regulator valves and other components of the injection completion, may be adjusted according to the specific environment and application. Similarly, the injection fluid and any complementary chemicals used to facilitate fracturing may be selected according to the parameters of the specific application and/or environment in which the technique is employed. The procedural stages of the methodology also may be adjusted to accommodate specific parameters of a given application employing the selective stream injection technique. Various candidate well screening techniques also may be employed to determine wells best suited for improved production through selective fracturing.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of enhancing hydrocarbon recovery, comprising:

isolating a selected formation layer of a plurality of formation layers along a wellbore in a subterranean region from a remainder of the plurality of formation layers;

using a selective injection stream technique to deliver fluid to the selected formation layer of the plurality of formation layers, wherein the fluid is deliverable to the selected formation layer independent of whether an adjacent one of the plurality of formation layers has had fluid delivered thereto, wherein isolating comprises isolating the plurality of formation layers from pressure exerted on the selected formation layer while fluid is delivered to the selected formation layer; and fracturing each formation layer of the plurality of formation layers, comprising employing a step rate test on at least one formation layer of the plurality of formation layers, wherein employing the step rate test comprises:

opening one of the formation layers of the plurality of formation layers by pumping fluid into the wellbore, wherein the one of the formation layers opens at a formation opening pressure;

flowing back the fluid such that the one of the formation layers is allowed to close;

opening the one of the formation layers one or more second times, wherein the formation opening pressure reduces each time the formation layer is opened;

determining that the formation opening pressure is less than an injection pressure at which a formation injection system is configured to supply fluid into the plurality of formation layers; and in response to determining that the formation reopening pressure is less than an injection pressure, ending the step rate test.

2. The method as recited in claim 1, wherein isolating comprises deploying packers into wellbore to isolate the plurality of formation layers along the wellbore.

3. The method as recited in claim 1, wherein using comprises using water flow regulators.

4. The method as recited in claim 1, wherein fracturing comprises injecting water into each formation layer while the other formation layers are isolated from the fracturing pressure of the water.

5. The method as recited in claim 1, further comprising enhancing the fracturing of each formation layer by delivering a complementary chemical into each formation layer.

6. The method as recited in claim 1, further comprising enhancing the fracturing of each formation layer by delivering an acid into each formation layer.

7. The method as recited in claim 1, further comprising monitoring the fracturing of each formation layer.

8. A method of enhancing hydrocarbon recovery, comprising:

employing a step rate test on at least one formation layer of a plurality of formation layers along a wellbore;

using a selective injection stream technique to direct fluid into at least one selected formation layer of the plurality of formation layers, wherein the fluid is directable to the at least one selected formation layer independent of whether an adjacent one of the plurality of formation layers has had fluid directed thereto; and isolating the other formation layers of the plurality of formation layers from pressure exerted on each selected formation layer while fluid is directed into each selected formation layer, wherein employing the step rate test comprises:

opening one of the formation layers of the plurality of formation layers by pumping fluid into the wellbore, wherein the one of the formation layers opens at a formation opening pressure;

flowing back the fluid such that the one of the formation layers is allowed to close;

opening the one of the formation layers one or more second times, wherein the formation opening pressure reduces each time the formation layer is opened;

determining that the formation opening pressure is less than an injection pressure at which a formation injection system is configured to supply fluid into the plurality of formation layers; and in response to determining that the formation reopening pressure is less than an injection pressure, ending the step rate test.

9. The method as recited in claim 8, further comprising fracturing each formation layer while isolating all other formation layers of the plurality of formation layers.

10. The method as recited in claim 8, wherein isolating comprises employing dummy valves at desired locations along the wellbore.

11. The method as recited in claim 8, wherein isolating comprises deploying packers in the wellbore to isolate individual formation layers of the plurality of formation layers.

12. The method as recited in claim 8, wherein using comprises directing a substantially proppantless injection fluid to one or more selected formation layers of the plurality of formation layers.

13. The method as recited in claim 9, further comprising enhancing fracturing by delivering a complementary chemical to each formation layer.

14. The method as recited in claim 8, wherein employing comprises employing a series of successively higher injection rates.

15. A method of improving vertical efficiency in a well, comprising:

isolating a plurality of formation layers along a wellbore from a selected formation layer;

using a selective injection stream technique to deliver fluid to the selected formation layer of the plurality of formation layers, wherein the fluid is deliverable to the selected formation layer independent of whether an adjacent one of the plurality of formation layers has had fluid delivered thereto, wherein isolating comprises isolating the plurality of formation layers from pressure exerted on the selected formation layer while fluid is delivered to the selected formation layer;

fracturing at least some of the plurality of formation layers, wherein fracturing comprises employing a step rate test on at least one formation layer of the plurality of formation layers, wherein employing the step rate test comprises:

opening one of the formation layers of the plurality of formation layers by pumping fluid into the wellbore, wherein the one of the formation layers opens at a formation opening pressure;

flowing back the fluid such that the one of the formation layers is allowed to close;

opening the one of the formation layers one or more second times, wherein the formation opening pressure reduces each time the formation layer is opened;

determining that the formation opening pressure is less than an injection pressure at which a formation injection system is configured to supply fluid into the plurality of formation layers; and in response to determining that the formation reopening pressure is less than an injection pressure, ending the step rate test;

introducing an injection fluid into the selected formation layer to stimulate the selected formation layer; and repeating the isolating and introducing for each of the plurality of formation layers to improve the vertical efficiency of the well.

16. The method as recited in claim 15, wherein isolating comprises actuating a plurality of packers along the wellbore.

17. The method as recited in claim 15, wherein introducing comprises introducing a water-based injection fluid.

18. The method as recited in claim 15, wherein introducing comprises controlling flow to the plurality of formation layers with a plurality of flow control devices.

19. The method as recited in claim 15, wherein introducing comprises controlling flow to the plurality of formation layers with a plurality of dummy valves positioned in corresponding side pocket mandrels.

20. The method as recited in claim 15, further comprising screening the well by injecting fluid according to a step rate test procedure.

21. The method as recited in claim 18, further comprising selectively actuating each of the plurality of flow control devices with a slickline.

* * * * *